US007134492B2

(12) United States Patent
Willberg et al.

(10) Patent No.: US 7,134,492 B2
(45) Date of Patent: Nov. 14, 2006

(54) MAPPING FRACTURE DIMENSIONS

(75) Inventors: Dean Willberg, Moscow (RU); Jean Desroches, Paris (FR); Kamal Babour, Bures sur Yvette (FR); Kais Gzara, Tunis (TN); Christian Besson, Le Pecq (FR)

(73) Assignee: Schlumberger Technology Corporation, Surgar Land, TX (US)

( * ) Notice: Subject to any disclaimer, the term of this patent is extended or adjusted under 35 U.S.C. 154(b) by 226 days.

(21) Appl. No.: 10/824,079

(22) Filed: Apr. 14, 2004

(65) Prior Publication Data

US 2004/0226715 A1 Nov. 18, 2004

Related U.S. Application Data

(60) Provisional application No. 60/463,868, filed on Apr. 18, 2003.

(51) Int. Cl.
*E21B 43/267* (2006.01)
*E21B 43/263* (2006.01)

(52) U.S. Cl. ..... 166/250.1; 166/280.2; 166/308.1; 166/299; 166/271

(58) Field of Classification Search ..... 166/250.1, 166/280.1, 280.2, 308.1, 299, 271
See application file for complete search history.

(56) References Cited

U.S. PATENT DOCUMENTS 2,867,172 A * 1/1959 Hradel ..... 102/310
3,456,489 A * 7/1969 Levenson ..... 73/11.07
3,456,589 A * 7/1969 Slykhouse et al. ..... 102/313
3,533,471 A * 10/1970 Robinson ..... 166/299
3,561,532 A * 2/1971 Fletcher et al. ..... 166/299
3,593,793 A * 7/1971 Kelseaux ..... 166/280.1
3,713,915 A * 1/1973 Fast ..... 149/2
3,825,452 A * 7/1974 Roberts ..... 149/38
4,057,780 A * 11/1977 Shuck ..... 367/86
4,557,771 A * 12/1985 Bencz et al. ..... 149/14
4,662,451 A * 5/1987 Boade ..... 166/299
5,346,015 A * 9/1994 Grundmann ..... 166/299
6,155,348 A * 12/2000 Todd ..... 166/280.2

OTHER PUBLICATIONS

*Creating an Explosion: The theory and practice of detonation and solid chemical explosives*—J.A. Burgess and G. Hooper, Physics in Technology, Nov. 1977, pp. 257-265.

*DBX™ Seismic Energy Source Technical Information Reference MSDS # 1316*—Dyno Nobel Inc.

*VIBROGEL™ Seismic Energy Source Technical Information Reference MSDS ™ 1019*—Dyno Nobel Inc.

*Towards the Miniaturization of Explosive Technology*—Proceedings of the 23rd International Conference on Shock Waves, 2001—D. Scott Stewart.

*Underwater Explosions as Acoustic Sources*—D.E. Weston, Proc. Phys. Soc., vol. 76, No. 2, pp. 233-249.

(Continued)

*Primary Examiner*—Kenneth Thompson
(74) *Attorney, Agent, or Firm*—Thomas O. Mitchell; Tim Curington; Robin Nava

(57) ABSTRACT

Hydraulic fracture dimensions and, optionally, fracture closure pressure and time are determined by adding particulate matter that discharges to create an acoustic signal to the proppant, allowing the particulate matter to discharge, and detecting the acoustic signal with geophones or accelerometers. The particulate matter may be spheres or fibers. The discharge may be explosion, implosion, detonation, or rapid combustion or ignition. The discharge may be triggered by fracture closure or by chemical reaction.

30 Claims, 4 Drawing Sheets

OTHER PUBLICATIONS

*Experimental Studies on Downhole Seismic Sources*—S.T. Chen, E.A. Eriksen and M. A. Miller, Geophysics, vol. 55, No. 12, pp. 1645-1651, Dec. 1990.

*Subsurface Imaging Using Reversed Vertical Seismic Profiling and Crosshole Tomographic Methods*.—S.T. Chen, L.J. Zimmerman and J.K. Tugnait, Geophysics, vol. 55, No. 11, pp. 1478-1487, Nov. 1990.

*Experimental Studies of Downhole Seismic Sources*—S.T. Chen and E.A. Eriksen ,Geophysics, presented at the 59th Ann, Internet, Mtg., Soc. Expl., Geophys., Expanded Abs.

SPE 68854—*Field Test of a Novel Low Viscosity Fracturing Fluid in the Lost Hills Field, California*—S. Vasudevan, D.M. Willberg, J.A. Wise, T.L. Gorham, R.C. Dacar, P.F. Sullivan, C.L. Boney and F. Mueller.

*Background for Hydraulic Fracturing Pressure Analysis Techniques*—S.N. Gulragani and K.G. Nolte, Appendix to Chapter 9: Reservoir Stimulation, 3rd Edition, M.J. Economides and K.G. Nolte—p A9-1 to A9-16.

SPE 15214—*Monitoring Hydraulic Fracture Stimulations with Long-Period Seismometers to Extract Induced Fracture Geometry*—F.J. Mauk and K.D. Mahrer.

SPE18538—*Uplifts and Tilts at Earth's Surface Induced by Pressure Transients from Hydraulic Fractures*. —Ian D. Palmer.

SPE 21834—*Microseismic Logging: A New Hydraulic Fracture Diagnostic Method*.—K.D. Mahrer.

SPE 27506—*Data Gathering for a Comprehensive Hydraulic Fracturing Diagnostic Project: A case Study*.—L.S. Truby, R.G. Keck and R.J. Withers.

SPE 30507—*Microseismic Mapping of Hydraulic Fractures Using Multi-Level Wireline Receivers*.—N.R. Warpinski, B.P. Engler, C.J. Young, R. Peterson, P.T. Branagan and J.E. Fix.

SPE 30738—*Hot Dry Rock: A Versatile Alternative Energy Technology*—D.V. Duchane.

SPE 36450—*Microseismic Monitoring of the B-Sand Hydraulic Fracture Experiment at the DOF/GRI Multi-Site Project*.—N.R. Warpinski, T.B. Wright, J.E. Uhl, P.M. Drozda, R.E. Peterson and P.T. Branagan.

SPE 38573—*Microseismic and Deformation Imaging of Hydraulic Fracture Growth and Geometry in the C Sand Interval, GRI/DOE M-Site Project*.—N.R. Warpinski, P.T. Branagan, R.E. Peterson, J.E. Fix, J.E. Uhl, B.P. Engler and R. Wilmer.

SPE 38574—*Progagation of a Hydraulic Fracture into a Remote Observation Wellbore: Results of C-Sand Experimentation at the GRI/DOE M-Site Project*.—P.T. Branagan, R.E. Peterson, N.R. Warpinski, S.L. Wolhart and R.E.Hill.

SPE 38576—*A Systematic Study of Fracture Modeling and Mechanics Based on Data from GRI/DOE M-Site Project*—T.B. Wright and T.W. Green.

SPE 38577—*Cotton Valley Hydraulic Fracture Imaging Project*.—Ray N. Walker, Jr.

SPE 40014—*Mapping Hydraulic Fracture Growth and Geometry Using Microseismic Events Detected by a Wireline Retrievable Accelerometer Array*.—N.R. Warpinski, P.T. Branagan, R.E. Peterson, S.L. Wolhart and J.E. Uhl.

SPE 47315—*Monitoring and Management of Fractured Reservoirs Using Induced Microearthquake Activity*.—A. Jupe, R. Jones, B.Dyer and S. Wilson.

SPE49194—*Carthage Cotton Valley Fracture Imaging Project—Imaging Methodology and Implications*.—R.N. Walker Jr., R.J. Zinno, J.B. Gibson, Ted Urbancic and Jim Rutledge.

SPE 57593—*Microseismic Monitoring of the B-Sand Hydraulic-Fracture Experiment at the DOE/GRI Multisite Project*.—N.R. Warpinski, T.B. Wright, J.E. Uhl, B.P. Engler, P.M. Drozda, R.E. Peterson and P.T. Branagan.

SPE 63034—*East Texas Hydraulic Fracture Imaging Project: Measuring Hydraulic Fracture Growth of Conventional Sandfracs and Waterfracs*.—Michael J. Mayerhofer, Ray N. Walker Jr., Ted Urbancic and James T. Rutledge.

SPE 64434—*State-of -the-Art in Hydraulic Fracture Diagnostics*. C.L. Cippola and C.A. Wright.

SPE 71649—*Analysis and Prediction of Microseismicity Induced by Hydraulic Fracturing*. N.R. Warpinski, S.L. Wolhart and C.A. Wright.

SPE 77442—*A Practical Guide to Hydraulic Fracture Diagnostic Technologies*.—R. D. Barree, M.K. Fisher and R. A. Woodroof.

SPE 77441—*Integrating Fracture Mapping Technologies to Optimize Stimulations in the Barnett Shale*.—M.K. Fisher, C.A. Wright, B.M. Davidson, A.K. Goodwin, E.O. Fielder, W.S. Buckler and N.P. Steinsberger.

SPE 77440—*Microseismic Imaging of Hydraulic Fracture Complexity in the Barnett Shale*. S.C. Maxwell, T.I. Urbancic, N. Steinsberger and R. Zinno.

* cited by examiner

MAPPING FRACTURE DIMENSIONS

CROSS-REFERENCE TO RELATED APPLICATION

This application claims the benefit of U.S. Provisional Patent Application No. 60/463,868, filed on Apr. 18, 2003.

TECHNICAL FIELD OF THE INVENTION

This invention relates generally to the art of hydraulic fracturing in subterranean formations and more particularly to a method and means for assessing hydraulic fracture geometry during or after hydraulic fracturing.

BACKGROUND OF THE INVENTION

Hydraulic fracturing is a primary tool for improving well productivity by placing or extending channels from the wellbore to the reservoir. This operation is essentially performed by hydraulically injecting a fracturing fluid into a wellbore penetrating a subterranean formation and forcing the fracturing fluid against the formation strata by pressure. The formation strata or rock is forced to crack, creating or enlarging one or more fractures. Proppant is placed in the fracture to prevent the fracture from closing and thus the fracture provides improved flow of the recoverable fluids, i.e. oil, gas or water.

The proppant is thus used to hold the walls of the fracture apart to create a conductive path to the wellbore after pumping has stopped. Placing the appropriate proppant at the appropriate concentration to form a suitable proppant pack is thus critical to the success of a hydraulic fracture treatment.

The geometry of the hydraulic fracture placed directly affects the efficiency of the process and the success of the operation. However, there are currently no direct methods of measuring the dimensions of a hydraulic fracture. The three methods currently used, pressure analysis, tiltmeter observational analysis, and microseismic monitoring of hydraulic fracture growth all require de-convolution of the acquired data for the fracture geometry to be inferred through the use of models—which is highly dependent on key assumptions—and often the results of these analyses verge on conjecture. All these methods use indirect measurements and are difficult to use except for post-job analysis rather than real-time evaluation and optimization of the hydraulic treatment. Moreover, these methods provide little information as to the actual shape of the propped fracture.

It is therefore an object of the present invention to provide a new approach to evaluating hydraulic fracture geometry.

SUMMARY OF THE INVENTION

The present invention is a method of assessing the geometry of a fracture using explosive, implosive or rapidly combustible particulate material added to the fracturing fluid and pumped into the fracture during the stimulation treatment. The particles are detonated or ignited during the treatment, subsequent to the treatment during closure, or after the treatment. The acoustic signal generated by these discharges is detected by geophones placed on the ground surface, in a nearby observation well, or in the well being treated. The technique is similar to that currently employed in microseismic detection—however in the current invention the signal is guaranteed to originate in the fracture.

BRIEF DESCRIPTION OF THE DRAWINGS

The above and further objects, features and advantages of the present invention will be better understood by reference to the appended detailed description and to the drawings.

DETAILED DESCRIPTION OF THE INVENTION

Figure 1:
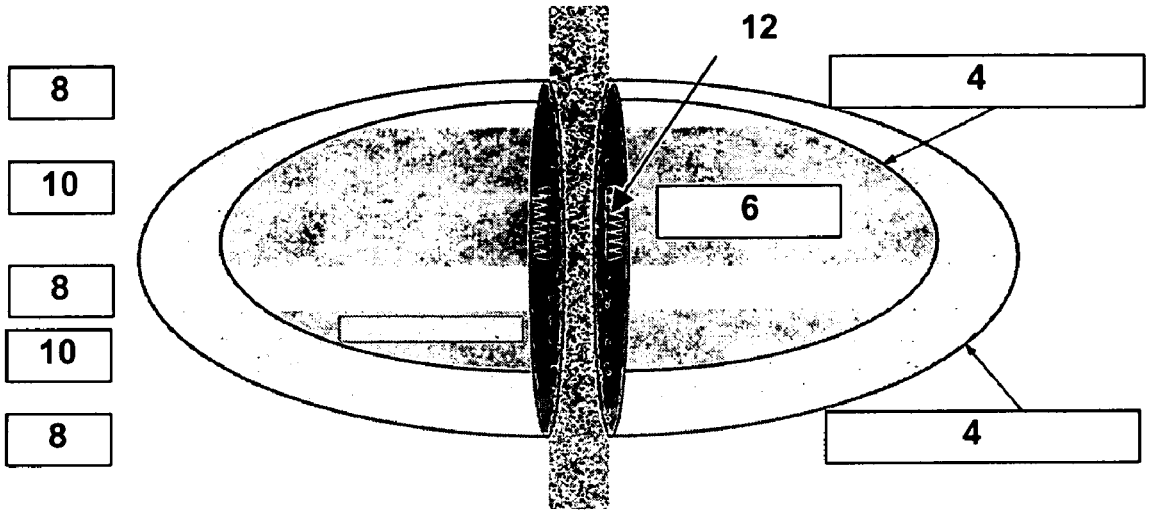
FIG. 1 is an illustration of the three fracture geometries: 1) created fracture, 2) propped fracture, and 3) effective fracture.

As illustrated in FIG. 1, there are three basic types of geometries one is interested in when monitoring a hydraulic fracturing treatment: that of the created fracture, where one looks for the boundary of the rock cracked open [2] during the treatment; that of the propped fracture, where one looks for the boundary of the proppant pack [4] after the fracture has closed, and that of the effective fracture, where one looks for the boundary of the fracture [6] as perceived by the reservoir and wellbore. Typically, the length and height of the effective fracture is less than that of the propped fracture, which itself is less than that of the created fracture. As one example, the reservoir in FIG. 1 contains non-pay strata [8] and pay strata [10], the perforations are at [12], and the effective fracture is the propped fracture region of the perforated pay stratum. The most desirable geometry to know is that of the effective fracture, followed by that of the propped fracture, followed last by that of the created fracture.

Presently there are three techniques for determining the geometry of hydraulic fractures. The first, which is highly indirect, involves fitting the pressure transient obtained during the treatment. This technique is highly conjectural, since only two variables are known, pressure at the wellhead and rate, while the overall pressure response is a function of at least six different properties. The accuracy of this process is improved using bottom hole pressure gauges—an infrequent operation due to the expense, and technical difficulties.

A second more direct method uses tilt meters to measure changes in the inclination of the surface of the earth in the vicinity of the well, or of a nearby observation wellbore. This method involves a significant effort to de-convolute the signal. Variations, such as "ragged" frac growth in layered formations cannot be readily discerned by this method.

A third method involves the detection of microseismic events triggered by the fracturing treatment—either during growth or closure. Fracture growth, rock dislocations, and slippages along bedding planes or natural fractures give rise to seismic events. The acoustic signatures of these events are detected by strings of geophones mounted on the surface of the earth, in the well being fractured, or in a nearby observation wellbore.

The one major disadvantage of the microseismic method is that the sources of the acoustic signal can occur a significant distance away from the fracture itself. These events form a "swarm" around the actual fracture. The dispersed distribution of these events makes the de-convolution of the fracture's actual dimensions somewhat difficult. Furthermore, a hydraulic fracture does not necessarily give rise to microseismicity, so that the absence of events does not imply there is no fracture propagating in the "silent" layers.

According to the present invention, small explosive charges or implosive sources are pumped into the fracture during the treatment. When these charges ignite, or explode, they generate an acoustic or seismic signature guaranteed to have originated within the fracture. Since the source of these acoustic signatures is guaranteed to be within the fracture, de-convolution of the resulting seismic transients is greatly simplified, and the map generated by this process is more accurate than currently available with the microseismic process. Throughout this specification we use various terms for the event that creates the acoustic or seismic signal. These terms include detonation, explosion, implosion, ignition, combustion, exothermic reaction, and other forms of these words as appropriate such as explosive, detonator, combustible, etc.; it is to be understood that we will use the generic term "discharge" (and other forms of the word as appropriate) to represent any and all of these events. However, when we specifically discuss detonators and explosive matter together, it is to be understood that in that case we mean that the detonation of the detonator in turn causes the explosion of the explosive matter (although both this detonation and this explosion are discharges).

As mentioned before, the invention requires the use of energetic materials, either explosives or propellants, to generate a detectable seismic signal at some distances. A short representative list of explosives used in oil and gas exploration and production operations is shown in Table 1. The enthalpy of reaction is used to approximate the energy released during the explosion as detailed in the following references incorporated herein by reference:

J. A. Burgess, and G. Hooper, *Creating an Explosion: The theory and practice of detonation and solid chemical explosives*, Physics in Technology, November 1977, pp 257–265.

Dyno Nobel Inc. dBX™ *Seismic Energy Source Technical Information Reference MSDS* #1316.

Dyno Nobel Inc. VIBROGEL™ *Seismic Energy Source Technical Information Reference MSDS* #1019.

TABLE 1

Representative Explosives

| Compound | $\Delta H$ (kJ $g^{-1}$) | $\rho$ (g $cm^{-3}$) | $u_{det}$ (m $s^{-1}$) |
|---|---|---|---|
| Lead Azide | 1.50 | 4.93 | 5100 |
| TNT | 3.90 | 1.60 | 6950 |
| RDX | 5.70 | 1.6–1.8 | 8640 |
| Vibrogel (Nitroglycerin Dynamite) | 5.22 | 1.43 | 6100 |
| dBX | 7.41 | 1.72 | 5500 |

For the present invention, suitable "noisy particles" should be small enough to be pumped during a fracturing treatment but sufficiently energetic to generate a signal that can be detected by geophones or accelerometers mounted in the well being fractured, in one or more observation wells, or on the surface. It is further preferred that the dimensions of the explosive device or material be on the same scale as the proppant so that they will not be segregated as the fracturing fluid/slurry travels down the fracture. From field experience pumping proppant, fibers, and proppant flow-back control materials, the representative sizes of particles that can be pumped with 20/40 proppant are listed in Table 2.

TABLE 2

Minimum and maximum power estimates for the seismic emissions of "pumpable" explosive particulate material

| Particle Shape | Diameter (mm) | Length (mm) | Volume ($cm^3$) | $m_{RDX}$ (mg) | $m_{LA}$ (mg) | Total $\Delta H_{part}$, RD> (J) | Total $\Delta H_{part}$, LA (J) | Estimate of Min. Acoustic Source Power (W) | Estimate of Max. Acoustic Source Power (W) |
|---|---|---|---|---|---|---|---|---|---|
| Sphere | 0.60 | | $1.1 \times 10^{-4}$ | 0.2 | 0.55 | 1.1 | 0.8 | 0.1 | 2.7 |
| Rod | 0.60 | 3.6 | $1.0 \times 10^{-3}$ | 1.6 | 5 | 9.1 | 7.5 | 0.7 | 22 |
| Fiber | 0.02 | 22 | $3.8 \times 10^{-6}$ | 0.006 | 0.02 | 0.03 | 0.03 | 0.003 | 0.1 |

Particles of these dimensions are typically smaller than most detonating devices in use today, and the physical dimensions of energetic materials do have a significant effect on the initiation and propagation of energetic fronts in the device. However, miniaturization of explosive sources is an area of active research for a number of civilian and military applications as discussed in D. Scott Steward, *Towards the Miniaturization of Explosive Technology*, Proceedings of the 23rd International Conference on Shock Waves, 2001, herein incorporated by reference. The minimum dimension for lead azide, a common primary explosive is on the order of 60 μm, therefore quite compatible with the construction of explosive devices of dimensions sufficiently small to be pumped into a fracture.

Although the enthalpy of even small explosive pellets, $\Delta H_{part}$, is quite high as shown in Table 2, only a fraction of the total energy is emitted as seismic (acoustic) radiation, $f_s$, over a detectable frequency range. For the following calculations, we will assume that detectable frequency range to be between 30 and 130 Hz (although frequencies as low as 1 Hz and as high as 10 Khz may be detectable).

The value of $f_s$ is difficult to determine, and is dependant on the size of the charge and the environment of the explosion. At the low end, the fraction of energy emitted as seismic radiation has been estimated as $f_s$~0.001. A high estimate can be made based on the results for underwater detonations reported on in D. E. Weston, *Underwater Explosions as Acoustic Sources*, Proc. Phys. Soc., Vol. 76, No. 2, pp 233–249. This paper reports the measured absolute acoustic source levels of 0.002, 1, and 50 lbm charges of TNT placed at various depths in seawater. The enthalpy change for the explosive detonation of 0.002 lbm (0.9 g) of TNT is ~4.3 kJ. From FIG. 2 in ref. 7 the energy flux over the 30–150 Hz frequency bandwidth can be calculated (at a distance of 300 ft) to be $\Phi_A=1.3\times10^{-3}$ $Jm^{-2}$. Assuming a radial distribution, $$U_{bndwth}=4\pi r^2\Phi_A \tag{1}$$

the acoustic energy emitted by the 1 g TNT charge over the 30–130 Hz bandwidth was ~0.13 kJ. Therefore $f_s$~0.13 kJ/4.3 kJ=0.03. If we assume that the energy is released in only a few cycles, a reasonable estimate considering the high detonation velocities for these materials, then the power of the acoustic pulse generated by a noisy particle is:

$$I_0\sim\nu f_s\Delta H_{part} \tag{2}$$

where, ν=seismic wave frequency (80 Hz is assumed for the calculations).

Based on these estimates for $f_s$, a single "pumpable" explosive particle can generate 0.1–22 W of power within the 30–130 Hz frequency range.

If an implosive particle is used as an acoustic source, for example a glass microsphere, then the energy contained in the particle is, $$U=P_{hyd}V_{sphere} \tag{3}$$

Assuming particle radius $R_{sphere}$~0.8 mm and a hydrodynamic pressure of 10,000 psi, the total energy of the particle is ~$1.8\times10^{-2}$ J. Again assuming $f_s$~0.001–0.03, and that the event is completed in one cycle, it can be estimated that the emitted power is between about 0.001 and 0.04 W.

Standard downhole geophones can typically detect particle velocity amplitudes in the magnitude of $A_{limit}\sim4\times10^{-8}$ $ms^{-1}$.

To a first approximation, accounting for both spherical wavefront spreading and signal attenuation due to internal friction, the amplitude of seismic waves generated by a point source an explosion can be assumed to decay according to, $$A = A_0\left(\frac{r_0}{r}\right)\exp\left(-\frac{\pi r}{Q\lambda}\right) \tag{4}$$

where $A_0$=the amplitude of the particle velocity at the source $r_0$=the radius of the source (a spherical radiator is assumed)

Q=the Quality factor (a parameter of the rock and its saturation)

λ=the wavelength of the sinusoidal seismic wave r=the distance separating the detector from the source.

By rearranging equation (4) the magnitude of a detectable event as a function of r can be shown to be:

$$A_0 = A_{limit}\left(\frac{r}{r_0}\right)\exp\left(\frac{\pi r}{Q\lambda}\right) \tag{5}$$

In order for the source to be detectable it must generate a signal with an average power of:

$$W_0=2\pi A_0^2 r_0^2\rho c \tag{6}$$

where,

ρ=the density of the rock c=the phase velocity (speed of sound)

Substituting (5) into (6) yields:

$$W_0 = 2\pi\rho c A_{limit}^2 r^2\exp\left(\frac{2\pi r}{Q\lambda}\right) \tag{7}$$

Experimental data for Q comes from a series of studies reported on in S. T. Chen, E. A. Eriksen, and M. A. Miller, *Experimental studies on downhole seismic sources, Geophysics*, Vol. 55, No. 12, pp 1645–1651, December, 1990; S. T. Chen, L. J. Zimmerman, and J. K. Tugnait, *Subsurface imaging using reversed vertical seismic profiling and cross-hole tomographic methods*, Geophysics, Vol. 55, No. 11, pp 1478–1487, November, 1990, and S. T. Chen and E. A. Eriksen, *Experimental studies on downhole seismic sources, Geophysics*, Presented at the 59$^{th}$ Ann. Internat., Mtg., Soc. Expl., Geophys., Expanded Abs, pp 812–815, 1989.

Figure 2:
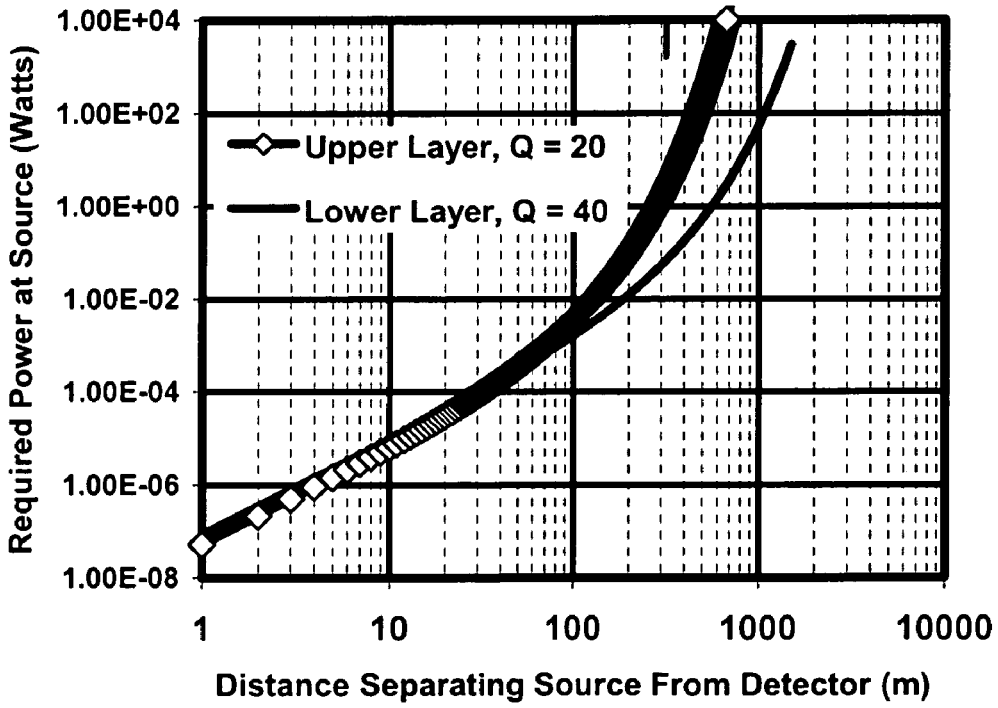
FIG. 2 is a graph showing the required seismic power at the source in order for the event to be detected at a distance r from the source.

These particular studies are appropriate for the present invention in that they used relatively small, 10–23 g, charges of dynamite as sources for reverse vertical seismic profiling. Signals were detected at distances of 122 to 366 m. Using equation (6) and values for Q, c, and λ obtained from a study reported on in S. T. Chen, E. A. Eriksen, and M. A. Miller, *Experimental studies on downhole seismic sources, Geophysics*, Vol. 55, No. 12, pp 1645–1651, December, 1990, the required power of the signal source, for two difference sandstones, can be estimated. Based on the results, a graph of required power as a function of the separation of source from detector is shown in FIG. 2. According to the estimates above, spherical or rod-shaped noisy particles can emit between 0.1 to 20 W of seismic power over the 30–130 Hz bandwidth. According to FIG. 2, signals of this magnitude can be detected 200–800 m away through homogeneous sandstone. Similarly, the estimate of the power released by an implosive source is between about 0.001 and 0.04 W. According to FIG. 2, signals of this magnitude can be detected at a distance of 70–300 m through homogeneous sandstone.

In one embodiment of the present invention, relatively large explosive charges are obtained by agglomerating or building a network out of smaller particles—thereby increasing the signal strength and overcoming the energy limit imposed by the particle size. For example, large explosive charges can be created in situ by pumping explosive material fabricated in a fibrous form that builds a continuous network within the fracture. Although the mass of the individual fibers is small, the mass of the connected fibrous network is quite large. A comparison with the fiber assisted transport (FAT) process provides an estimate of the size of the explosive charges that can be constructed in situ by this method. Polymeric fibers have been pumped in fracturing fluids at concentrations in excess of 10 g $L^{-1}$ with proppant concentrations up to 1.5 kg added per liter of fluid. Accounting for the higher density, it is possible to pump at least 12 g $L^{-1}$ of RDX or TNT. At these concentrations there exists a continuous network of fibers sufficiently entangled that it can support and transport proppant. (see Vasudevan, S., Willberg, D. M., Wise, J. A., Gorham, T. L., Dacar, R. C., Sullivan, P. F., Boney, C. L., Mueller, F., "Field Test of a Novel Low Viscosity Fracturing Fluid in the Lost Hills Field, Calif." paper SPE 68854 presented at the 2001 SPE Western Regional Conference, Bakersfield, Calif., U.S.A., March 28–30). If 5–10 kg of proppant is placed per square meter of fracture, typical for a fracture in hard rock formations, then the concentration of explosive material per area in the fracture is 63–126 g $m^{-2}$. A 1 m disk in the fracture contains between about 50 and 100 g of explosive, much larger charges then those used in the S. T. Chen et al. references above.

Figure 3:
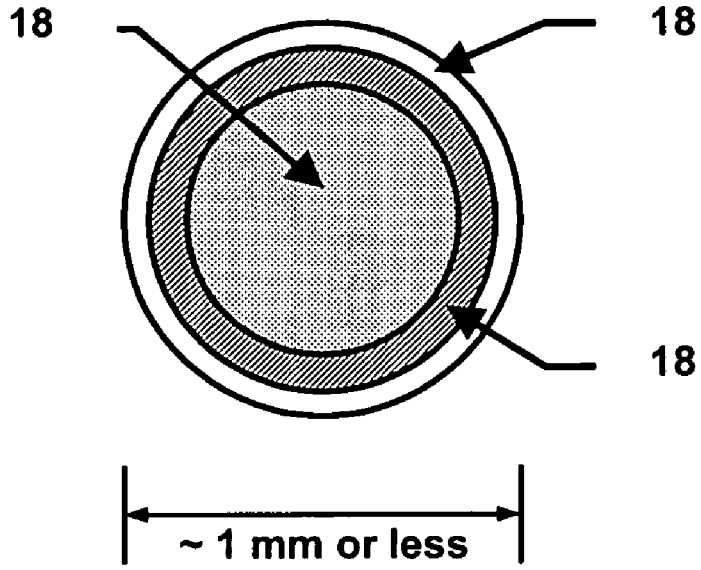
FIG. 3 is a schematic diagram of one design for an explosive particulate.

According to one embodiment of the present invention, the explosive and detonators are constructed in a spherical shape as shown in FIG. 3. In this configuration the primer is preferably constructed to detonate when the capsule undergoes anisotropic stress under closure. One method to construct such a device is to layer materials, like an onion, that will mix reactive components upon crushing/deformation. In FIG. 3, a protective shell [14] is around the primer (or detonator) [16] which in turn is around the explosive charge [18]. In this configuration, it is desirable that the particle be approximately the same size as a grain of proppant (i.e. ~1 mm in diameter).

According to another embodiment of the present invention, exposure to either the treating fluid or the fracturing fluid itself triggers the detonation/ignition (discharge) of the reactive particle. For example a water reactive primer, such as an alkali metal, triggers detonation. In this embodiment a shell either 1) with a controlled permeability to water, or 2) that slowly degrades or dissolves, covers the particle. When water penetrates this shell it activates the primer, which in turn ignites or detonates the particle. The composition and construction of the shell is such that detonation/ignition is sufficiently delayed in time so that it will occur when the particle is well down the fracture. An example of a protective shell is slowly hydrolyzing polyester. The advantage of this embodiment is that the signal is generated real-time during the treatment. An engineer monitoring the treatment observes the growth of the fracture, and fluid placement, while the job is still in progress. Information from these observations is used to update or modify the treatment in a timely manner. Using a mix of different shell thicknesses on different particles further provides the ability to "time stamp" the signals: the particles of different shell thicknesses detonate/ignite at different, specified, time intervals, providing a "movie" of the evolution of the fracture geometry.

A variation of this embodiment is to allow the noisy particle to signal the production of oil or condensate. In this situation the shell is made of a material that reacts, softens, weakens or becomes more permeable to water upon exposure to oil produced by the reservoir. Again the water-reactive primer detonates or ignites the particle upon exposure to the connate or produced water that is commingled with the produced oil/condensate. The particular advantage of this variation is that it gives the practitioner insight into the geometry of the effective producing geometry of the fracture in some reservoirs.

In yet another embodiment of this invention, implosive particles, such as hollow glass spheres, are added to the slurry. The acoustic signal is released when the sphere is crushed, subjected to anisotropic stress, or ruptured by the hydrostatic pressure after mechanical or chemical degradation of the shell (the skin of the hollow sphere). The advantage of this embodiment is that these particles are relatively safe to deploy as compared with explosive/energetic particles, and their trigger mechanism is relatively simple. However, the major disadvantage of this embodiment is the low energy content of the particles, therefore it is best used in combination with detectors mounted close to the hydraulic fracture, for example in the well from which the fracture is being generated. One method is to place the detectors in the wellbore below the fracture, preferably with a shield to protect them from proppant.

In yet another embodiment of the present invention, different types of particle materials or particle materials embedded into different type of protective shells are used to allow the detonation/ignition/combustion (discharge) to occur, one-by-one over time in a random fashion or triggered by different events such as the fracture closure, the entry of specific type of formation fluids etc.

Figure 4:
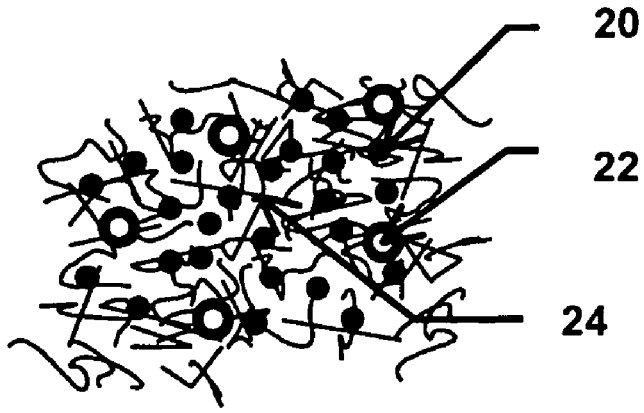
FIG. 4 is a schematic diagram showing a mixture of explosive fiber, detonators (primers) and proppant.
Figure 5:
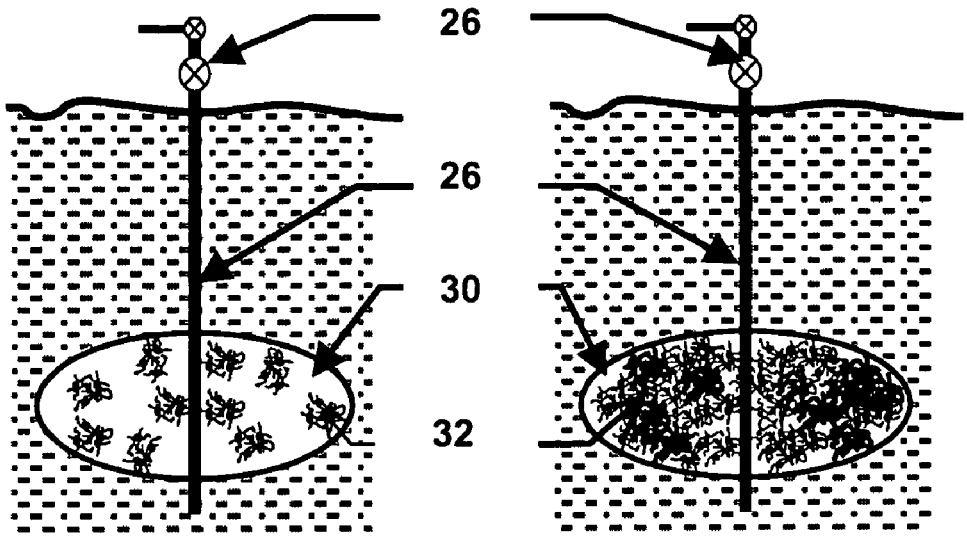
FIG. 5 is a schematic diagram illustrating two alternative embodiment of the present invention: on the left where fiber/detonators are pumped at discrete intervals throughout the treatment (slugged) and on the right where the fibers and detonators are pumped continuously throughout the treatment.

As mentioned before, it may be advantageous to use small pumpable explosive/combustible particles included in the fracturing fluid that by agglomerating, or by creating extended networks within the fracture, form relatively large charges in situ. This embodiment greatly increases the size of the seismic signal generated in the hydraulic fracture. Depending on the Q of the formation, or the location of the detectors with respect to the hydraulic fracture, the acoustic signature generated by an explosive particle approximately 1 mm in diameter may be undetectable but the agglomerate allows a detectable acoustic signature. In one embodiment the detonators (primers) and the explosive are pumped separately. detonation In yet another preferred embodiment, the explosive is fabricated as a fiber, ribbon or long rod. Alternatively the explosives are pumped as a granular material. In both situations the method relies on the discharge of multiple grains, ribbons, or fibers to generate the acoustic signature. One advantage of a fiber (or rod-shaped) material is the high degree of connectivity in fibrous suspensions—this helps guarantee that a detonation wave propagates thoroughly throughout all the explosives in the fracture. A representative example is shown in FIG. 4, in which the proppant (that is optional in this embodiment and may or may not be present) is shown as small filled spheres [20], the detonator (primer) is shown as larger open spheres [22], and the explosive (or combustible fiber or particle) are shown as curved lines [24]. Note that the mixture of fibers and detonators may also be pumped in the pad, and does not necessarily require the proppant to be present. A granular explosive should be pumped at a higher concentration in order to maintain connectivity from one explosive particle to the next. Explosive, or rapidly combustible, fibers may be pumped continuously throughout the job (as shown on the right hand side of FIG. 5), or slugged at discrete intervals during the treatment (as shown on the left hand side of FIG. 5). In FIG. 5, the wellhead (Christmas tree) is shown at [26], the wellbore is shown at [28], the hydraulic fracture is shown at [30], and the mixture of explosive material and detonator is shown at [32].

In a variation of this embodiment, the proppant itself is coated with an explosive or ignitable material, similar to resin coated proppant (RCP) and the detonators/primers are pumped separately. This variation of the invention also ensures that the source of the acoustic events is co-located with the proppant.

Combinations of different types of "noisy materials" may be particularly useful. For example water-activated particles may be pumped simultaneously with crush-activated particles. The water-activated particles give an engineer monitoring the operation real-time information regarding the growth of the fracture during the treatment. The crush activated particles give the engineer information regarding the geometry of the fracture at closure. The "noise" may also signal the exact instant of fracture closure and therefore allows an unambiguous determination of the closure pressure. The important of the closure pressure is emphasized in S. N. Gulragani and K. G. Nolte, Appendix to Chapter 9: *Background for Hydraulic Fracturing Pressure Analysis Techniques*, p A9-1 to A9-16 in *Reservoir Stimulation, 3rd Edition*, M. J. Economides and K. G. Nolte, editors New York, John Wiley and Sons Ltd, 2000. Closure pressure is typically obtained by observing changes, unfortunately sometimes extremely small, in the slope of the graph of pressure as a function of time during a short pre-treatment (often called a Datafrac) performed without proppant. Note that this application does not requiring the full complement of detectors and data processing procedures required for actual fracture imaging. In this embodiment crush activated noisy particulate is included in the Datafrac and/or in the actual treatment. The noisy particles generate the acoustic/seismic signal when the fracture walls close on the particulates. The closure of the fracture to a width smaller than the diameter of the explosive particles is positively identified. If the pressure is being monitored in this process then the closure pressure, or range of closure pressure, is determined. Furthermore, this process may be replicated at the end of the actual fracturing treatment. By comparing the results, variations in closure pressure caused by fluid imbibition into the formation, or other factors, may be monitored.

Figure 6:
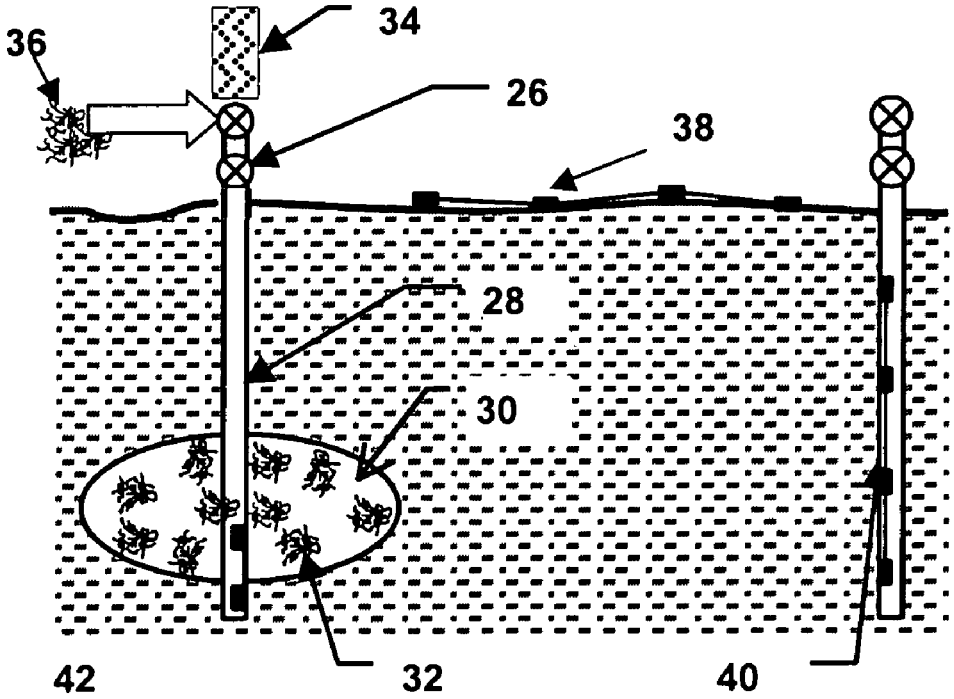
FIG. 6 is a schematic of the overall process and equipment layout.
Figure 7:
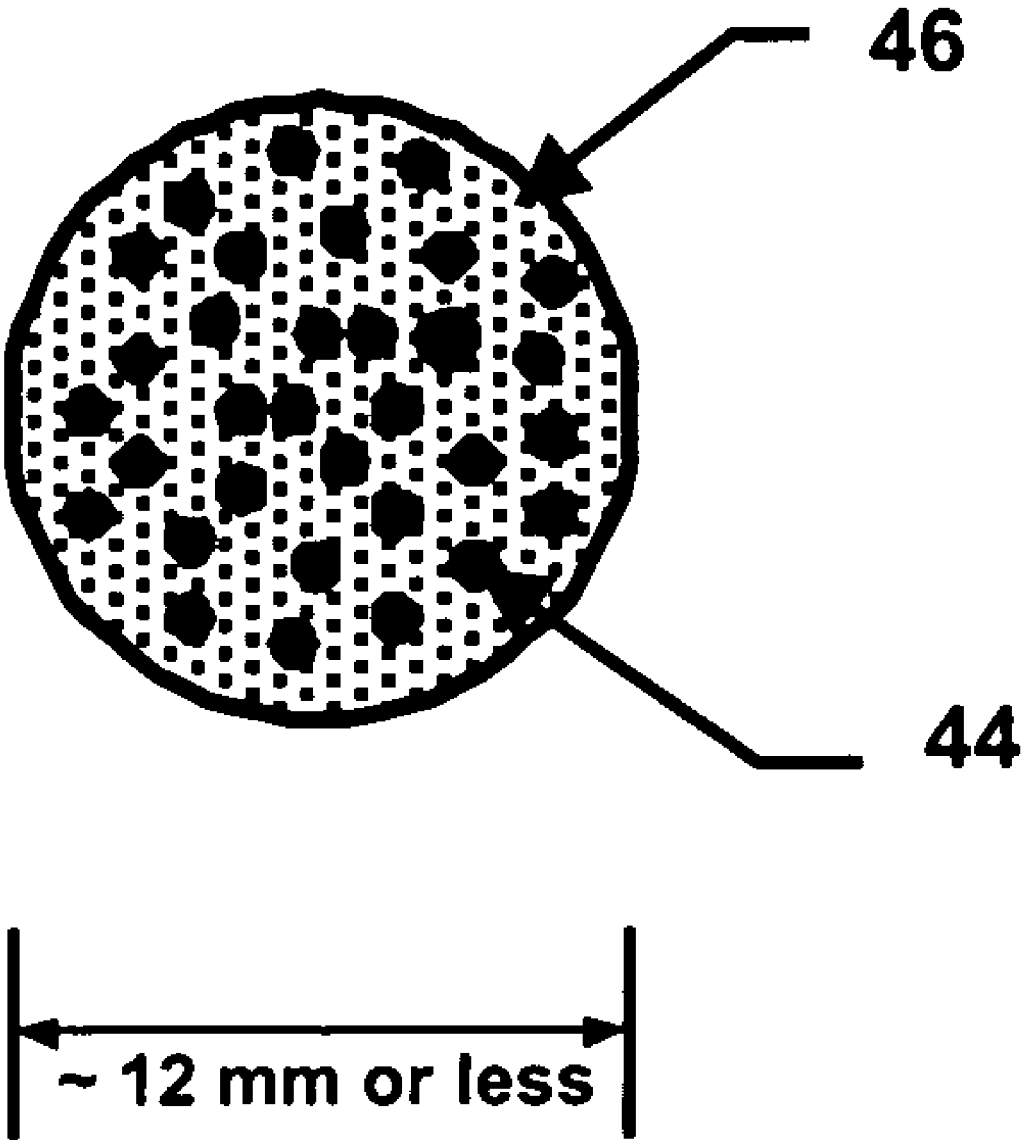
FIG. 7 is a schematic showing detonator capsules (primers) embedded in a protective matrix shaped as a ball.

The noisy particles of the invention may be introduced into the treatment fluid at the wellhead through a ball injector or similar device as shown in FIG. 6. To improve operational safety, the primers/detonators and explosives may be pumped separately. Some explosives and propellants are much safer to handle than others—therefore some materials have an inherent advantage. The explosive fibers/granules may be fabricated with a water-soluble sizing or "safety layer" on their surfaces that prevents propagation of a combustion/detonation wave through the material while it is being handled. The addition of the detonators/primers at the wellhead [26] via a ball injector or similar device [34] means that these potentially pressure or shock sensitive devices are not be pumped through the valves on the triplex pumps. Explosive fibers are added at a blender [36]. In FIG. 7, geophones are shown in three optional locations: on the surface [38], in an offset well [40], and at the bottom of the well being fractured [42].

As shown in FIG. 7, the detonators (sometimes called detonator caps or primers) [44] may also be embedded in a water-soluble protective matrix (or a matrix that disintegrates during pumping) [46], that protects the capsules during handling on the surface. The ball may be delivered via a ball injector. The matrix disintegrates as the ball is being pumped downhole, releasing the detonators.

The noisy particles have another use. The detonation, ignition or exothermic reaction may be used to create localized high rate fluid motion. This motion may be used to mix chemicals in the fluid in the proppant pack, to initiate reactions in the fluid in the proppant pack, to break capsules containing chemicals (for example, acids) in the proppant pack, and to create localized high shear in the fluids in the proppant pack.

The invention claimed is:

1. A method of treating a subterranean formation with a treatment fluid comprising a proppant including the steps of a) adding to the treatment fluid a noisy particulate material selected from the group consisting of explosive, implosive, rapidly combustible, and energetic particulate material, b) pumping said treatment fluid into the subterranean formation through a well, and c) allowing the discharge of said particulate material.

2. The method according to claim 1 further comprising detecting the acoustic signals generated by said discharge.

3. The method according to claim 2, wherein said method of treating is hydraulic fracturing.

4. The method according to claim 3, further including the step of inferring a dimension of a fracture based on the detected acoustic signals.

5. The method according to claim 1, wherein said discharge is initiated during the pumping phase.

6. The method according to claim 3, wherein said discharge is initiated during fracture closure.

7. The method according to claim 3, wherein said discharge is initiated after fracture closure.

8. The method according to claim 7, wherein said discharge is initiated after the well is put onto production.

9. The method according to claim 2, wherein said acoustic signals are detected by detecting means selected from the group consisting of geophones and accelerometers.

10. The method of claim 9, wherein said detecting means are placed on the ground surface.

11. The method of claim 9, wherein said detecting means are placed in a different well.

12. The method of claim 9, wherein said detecting means are placed in the well being treated.

13. The method according to claim 1, wherein the particulate material comprises hollow glass spheres.

14. The method according to claim 1, wherein the particulate material comprises a protective shell.

15. The method according to claim 14, wherein the particulate material comprises capsules including an explosive charge and a detonator within a protective shell.

16. The method according to claim 15, wherein the discharge of the capsules is initiated when the capsules undergo anisotropic stress.

17. The method according to claim 1, wherein the discharge of the particulate material is triggered by exposure of the particulate material to the treating fluid or a formation fluid.

18. The method of claim 17, wherein the particulate material is encapsulated into an enclosure that delays said exposure.

19. The method according to claim 2, wherein the particulate material allows the discharge to occur at more than one time.

20. The method according to claim 2, wherein the discharge of the particulate material is triggered by more than one means.

21. The method according to claim 2, wherein the particulate material is a mixture of explosive matter and detonators.

22. The method of claim 21, wherein the explosive matter comprises fibers.

23. The method of claim 21, wherein the explosive matter comprises a coating provided on at least part of the proppant.

24. The method according to claim 3, wherein the discharge is used to determine the time of the fracture closure and the closure pressure.

25. The method according to claim 1, wherein the noisy particulate material comprises a compound selected from the group consisting of lead azide, TNT, RDX, nitroglycerin dynamite, dBX and combination thereof.

26. The method according to claim 21, wherein the detonator comprises a compound selected from the group consisting of alkali earth metals, alkali metals and thermite systems.

27. The method according to claim 21 wherein the detonators and explosive matter are pumped during different pumping stages.

28. The method according to claim 21 wherein the detonators comprise a safety layer to avoid early detonation during pumping.

29. The method according to claim 21 wherein the explosive matter comprises a safety layer to avoid early detonation during pumping.

30. The method according to claim 1, wherein the discharge provides localized high rate fluid motion.

* * * * *